United States Patent [19]

Habraken et al.

[11] 4,431,940

[45] Feb. 14, 1984

[54] COLOR DISPLAY TUBE HAVING A DEFLECTION DEVICE AND DEFLECTION DEVICE FOR A COLOR DISPLAY TUBE

[75] Inventors: Adrianus M. Habraken; Nicolaas G. Vink; Adriaan J. Groothoff; Marcellis H. J. Driessen, all of Eindhoven, Netherlands

[73] Assignee: U.S. Philips Corporation, New York, N.Y.

[21] Appl. No.: 282,126

[22] Filed: Jul. 10, 1981

[30] Foreign Application Priority Data

Jul. 17, 1980 [NL] Netherlands ..... 8004114

[51] Int. Cl.[3] ..... H01J 29/76; H01F 1/00

[52] U.S. Cl. ..... 313/413; 313/440; 335/212

[58] Field of Search ..... 313/440, 413, 431; 335/212, 213

[56] References Cited

U.S. PATENT DOCUMENTS

| | | | |
|---|---|---|---|
| 3,165,677 | 1/1965 | Gostyn et al. | 335/212 |
| 3,287,605 | 11/1966 | McGlashan | 335/213 X |
| 4,200,851 | 4/1980 | Nieuwendijk et al. | 335/213 X |

*Primary Examiner*—Palmer C. Demeo

*Attorney, Agent, or Firm*—Thomas A. Briody; William J. Streeter; Edward W. Goodman

[57] ABSTRACT

In a television deflection device which is mounted on a color cathode ray tube, a frustoconical supporting member (3) has a pair of coil halves (6) and (7) which form horizontal deflection coils halves. These coils have longitudinal portions (11, 12, 14 and 15) which extend to the front and the rear of the supporting member (3), an elongate tapered spacer (17) and (18) being inserted in the spaces between adjacent longitudinal portions of these coils. Movements of the spacers (17) and (18) adjust the space between the longitudinal portions which provides mechanical means for correcting for asymmetries in the display device.

23 Claims, 7 Drawing Figures

COLOR DISPLAY TUBE HAVING A DEFLECTION DEVICE AND DEFLECTION DEVICE FOR A COLOR DISPLAY TUBE

BACKGROUND OF THE INVENTION

The invention relates to a color display tube having three electron guns positioned in one plane for projecting three electron beams towards a display screen, and having a deflection device which is mounted on the display tube, said deflection device having a substantially frusto-conical supporting member with a front end facing said display screen having a large diameter and a rear end facing said electron guns having a relatively small diameter, which member supports a first set of deflection coils arranged about the longitudinal axis of said tube for deflecting the three electron beams in a first direction, and a second set of deflection coils arranged about said axis for deflecting the three electron beams in a second direction orthogonal to said first direction, the first set of deflection coils comprising two coils one of which is provided opposite to and spaced from the other in the supporting member with each coil being formed by two longitudinal parts extending substantially parallel to the said axis and being connected at their respective front and rear ends by transverse parts.

Due to mechanical spreads in the production and/or assembly of deflection coils with two longitudinal parts which are connected by transverse parts (so-called saddle-type coils) for deflection devices in color television sets, asymmetries can hardly be avoided.

Asymmetries in the coil halves cause certain picture defects. It is known from Netherlands Patent Specification No. 148,881 that such defects can be corrected by providing four auxiliary coils with the current through the turns of said auxiliary coils being in such a direction and of a value that a correction quadrupole field, which can be reversed in polarity, is generated which is substantially proportional to the deflection current through one deflection coil and/or to the deflection current through the other deflection coil.

This known (electromagnetic) correction device, which requires winding four extra coils and a circuit arrangement for energizing said coils, is complicated and hence expensive.

SUMMARY OF THE INVENTION

It is the object of the invention to provide a mechanical correction means instead of an electromagnetic correction means which is relatively simple and, possible, less expensive.

In order to reach the end in view, the color display tube having a deflection device of the kind mentioned in the opening paragraph is characterized according to the invention in that adjusting means cooperating with the longitudinal parts of the coils of the first set of deflection coils are provided so as to vary, for the correction of asymmetry defects of the first set of deflection coils, the distances between the adjoining longitudinal parts at least at one end of the supporting member. If needed pressure means for pressing said longitudinal parts against the adjusting means may be provided.

When using adjusting means to adjust the distance between the adjoining longitudinal parts of the two coils of the first set selectively, the effect of the adjustment on asymmetry and/or astigmatic defects can be observed on the screen of a measuring tube on which the deflection device is placed during the manufacture.

For optimum adjustment, it is of importance for the two coils of the first set of deflection coils to be symmetrical relative to the plane in which the three electron guns are positioned.

A first preferred embodiment of the color display tube having a deflection device according to the invention is characterized in that the adjusting means comprises two wedge-shaped spacers each of which is movable in the longitudinal direction of the respective spaces formed between the adjoining longitudinal parts.

A second preferred embodiment of the color display tube having a deflection device according to the invention is characterized in that the adjusting means comprise two eccentrics which are rotatable about axes and which are respectively positioned in the spaces formed between the adjoining longitudinal parts.

A third preferred embodiment of the color display tube having a deflection device according to the invention is characterized in that the adjusting means comprises four cams which are movable in the front of the supporting member and which each cooperate with an internal surface of one of the corners formed between a longitudinal part and a front transverse part, in which, for increasing the distance between a first set of two oppositely located longitudinal parts and simultaneously reducing the distance between the other said of oppositely located longitudinal parts, the cams cooperating with the first set of deflection coils can be moved apart, and conversely.

When using movable wedges which engage the coils, it will, in most of the cases, be practical to place the coils under a certain spring pressure in order that they follow a displacement of the wedges optimally. If, on the contrary, the support member is provided with movable cams, said cams may be positioned so that they themselves take along the coils during their displacement.

An alternative construction in which no spring means are necessary is formed by a supporting member consisting of two or more parts, the parts being movable relative to each other and taking along the coils during their movements. The supporting member may be divided into two parts, for example, on the front end and in the conical portion along a plane in which the three electron guns are positioned. By means of two eccentrics, the two parts can be moved towards each other or pressed apart in order to adjust the distance between the axial parts of the (line) coils rigidly fixed on the parts of the supporting member. An extra advantage is that upon adjusting the coils, their fixed position on the supporting member is maintained, which is not the case in the above-mentioned constructions. As a result of this, the stability of the coils is better ensured.

A modified embodiment of this latter concept is formed by a supporting member in which each axial coil part is secured to a partially cut-out part of the supporting member. By means of an eccentric journalled on the fixed portion of the supporting member, a pair of two oppositely located cut-out parts, which are provided with projections cooperating with the eccentric, may be forced towards each other or away from each other while taking along the coils secured to said cut-out parts. As with the above-described means, these adjusting means may be provided on the front side and/or on the rear side of the deflection device.

DESCRIPTION OF THE DRAWINGS

The invention, which also relates to a deflection yoke for a color display tube, will now be described in greater detail, by way of example, with reference to the drawings, in which.

DESCRIPTION OF THE PREFERRED EMBODIMENTS

Figure 1:
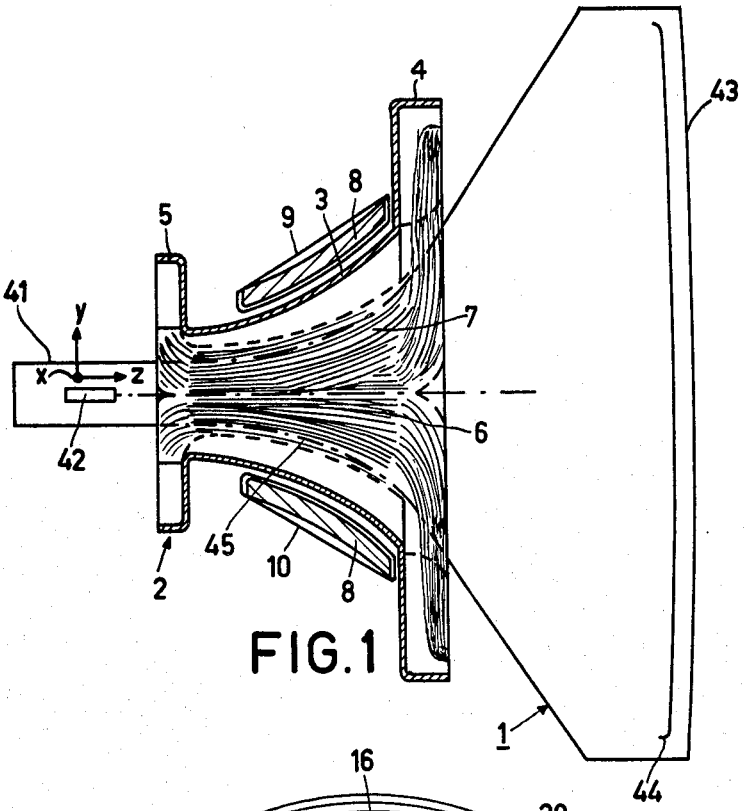
FIG. 1 is a diagrammatic cross-sectional view (taken along the Y-Z plane) of a deflection device mounted on a color television display tube.

An in-line color television display tube 1 is a display tube of the type in which an electron gun configuration 42, for producing three electron beams situated in one plane, is placed in the rear neck portion 41 and in which recurrent groups of blue, red and green phosphor dots are provided on the screen part 43 before a shadow mask 44. Between the rear neck portion 41 and the screen part 43 an envelope 45 varying from narrow to wide is present.

Referring now to FIG. 1, a deflection device 2 for such a display tube 1 comprises a spread or support 3 of insulating material having a front upright end 4 and possibly a rear upright end 5. Between said ends 4 and 5, two line deflection coils halves 6 and 7 are present on the inside of the support 3 and a ring core 8 of magnetizable material is present on the outside of the support 3 on which core a field deflection coil, consisting of two oppositely located halves 9 and 10, is wound toroidally. The field deflection coil halves 9 and 10 may alternatively be of the—self-supporting—saddle type.

The two halves 6 and 7 of the line deflection coil are of the saddle-type having two upright ends. However, they may also be of the type having only a front upright end and a rear end which is formed to conform closely to the surface of the display tube so that the upright rear end 5 of the support 3 may be omitted and it becomes possible to use an undivided ring core 8.

Figure 2:
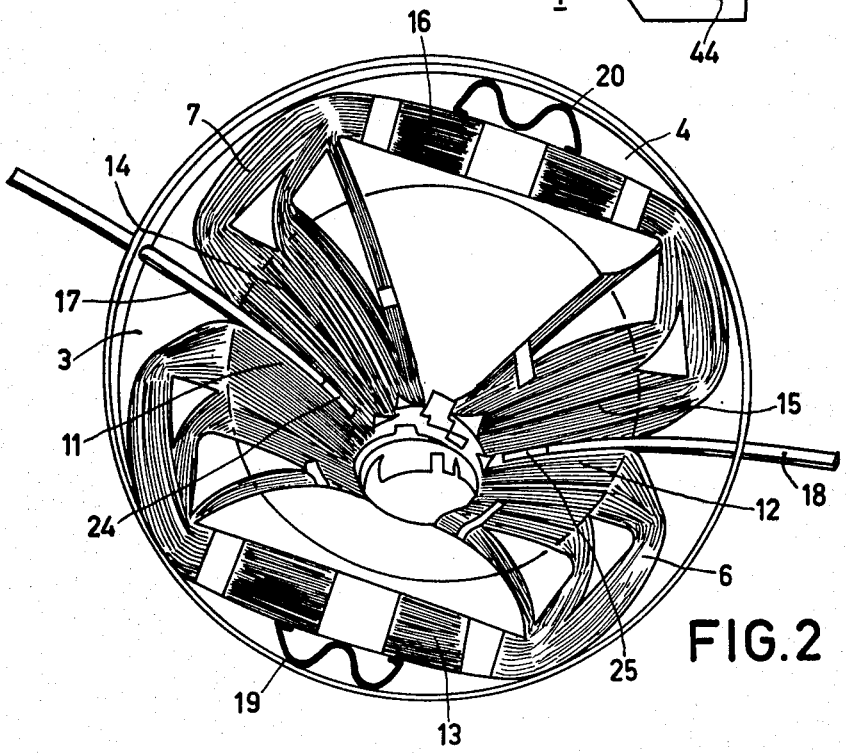
FIG. 2 shows, on a slightly enlarged scale, a perspective view of the deflection device of FIG. 1 and shows in particular one adjusting means for varying the distance between the line coil halves.
Figure 4:
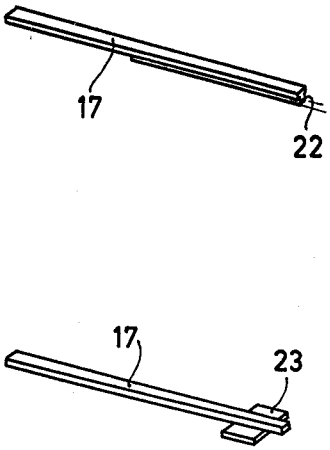
FIG. 4 is a perspective view of a further modified embodiment of an adjusting means which may be used in the invention.
Figure 3:
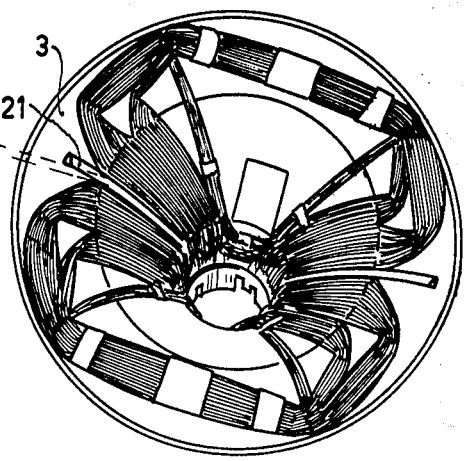
FIG. 3 shows diagrammatically the same elevation as FIG. 2 with a modified embodiment of an adjusting means used in the invention.

In FIGS. 2, 3 and 4 the same reference numerals as in FIG. 1 are used for the same components. It will be obvious from FIG. 2 that two (line) deflection coils halves 6 and 7 are present on the inside of the support 3. The coil half 6 has two longitudinal parts 11 and 12 which are connected at the front by a transverse part 13. The coil half 7 has two longitudinal parts 14 and 15 which at the front are connected by a transverse part 16. A separate spacer 17 is present between the adjoining longitudinal parts 11 and 14 and a similar separate spacer 18, is provided between the adjoining longitudinal parts 12 and 15. The width of the spacers 17 and 18, which are preferably manufactured from a synthetic material is tapered from the portion at the front of the support member towards the portion at the rear. The longitudinal parts 11 and 12 (the "body") of coil half 6 are pressed against the spacers 17 and 18 by the force which a resilient element 19 exerts on the transverse part 13, while the longitudinal parts 14 and 15 (the "body") of coil half 7 is pressed against the spacers 17 and 18 by the force which a resilient element 20 exerts on the transverse part 16, the resilient members 19 and 20 being present between a lip on the support member 3 and the connected front transverse parts 16 and 13.

The "bodies" of the coil halves 6 and 7 do not bear against the support member 3 so that their positions are exclusively determined by the enclosure of their front ends 13 and 16, respectively, between the resilient elements 19 and 20, respectively, and the spacers 17 and 18. Initially the spacers 17, 18 are forced towards the rear of the support member 3 as far as possible (space between the coil halves is maximum) and during adjustment these spacers are retracted independent of each other until the asymmetry defects, occurring during the manufacture and/or assembly, have been corrected. So during the adjustment, the width of the spaces between the coil halves 6 and 7 becomes smaller. The spring pressure exerted on the front ends 13, 16 ensures that the "bodies" of the coil halves 6, 7 follow the retraction of the spacers 17, 18. It is important that the symmetrical location of the coil halves 6, 7 to be maintained during the adjustment, in other words, the spacers 17 and 18 must be guided symmetrically. An auxiliary means for this purpose is a slot or groove 21 provided in the X-Z plane in the support 3 into which a ridge 22 formed on the spacer 17 fits, as shown diagrammatically in FIG. 3. Furthermore, the spacer 17 can be safeguarded against tilting by providing the lower side thereof with a pad 23 projecting on either side, as is shown in FIG. 4, which lies below the "bodies" of the coil halves 6 and 7. The separate spacers 17, 18 need not continue into the rear end of the support 3. Fixed projections 24, 25 having a width not smaller than the smallest width, but not larger than the large width, of the loose spacers 17 and 18 in FIG. 2 are preferably located on the rear part of the support member 3.

Figure 5:
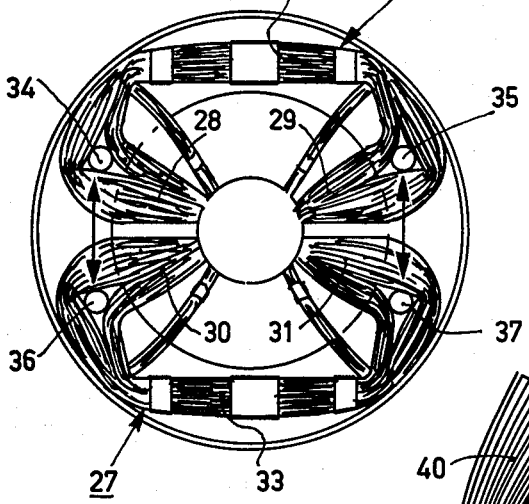
FIG. 5 shows diagrammatically an elevation of a deflection device which can be compared to the elevation of FIG. 2, but having alternative adjusting means.

The use of separate wedge-shaped spacers makes it possible to adjust the distances between the coil halves independently of each other, which provides the maximum number of correction possibilities. During the adjustment, the coil halves are not moved parallel to each other. When it is preferred to move the coil halves parallel to each other indeed, an alternative solution is possible within the scope of the invention. A diagrammatic construction thereof is shown in FIG. 5. This figure is a front elevation of two line coil halves 26 and 27. At the regions where their longitudinal parts 28, 29 and 30, 31, respectively, are connected by transverse parts 32 and 33, respectively, rotatable cams 34, 35, 36, 37 are present. By moving the cams 35 and 37 apart, the distance between the parts 29 and 31 becomes larger and that between the parts 28 and 30 becomes smaller, the sum of the distances remaining constant. However, this way of adjustment does not permit adjusting the distances independently of each other and therefore does not present the maximum number of correction possibilities.

Figure 6:
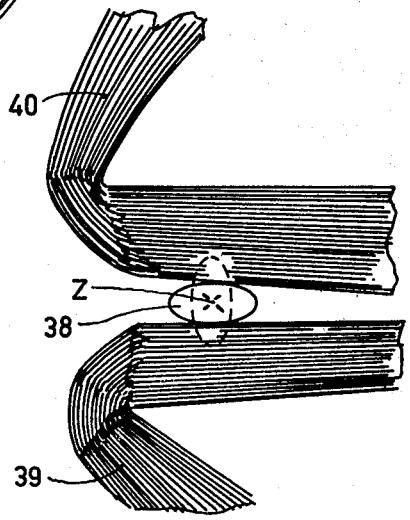
FIG. 6 shows parts of two oppositely located line coil halves and an eccentric with which their distance can be varied.

Another adjusting possibility is shown with reference to FIG. 6. This possibility comprises the use of eccentrics which are rotatable about an axis Z (for example in the form of elliptical members, as the member 38) between two adjoining longitudinal parts 39 and 40.

Figure 7:
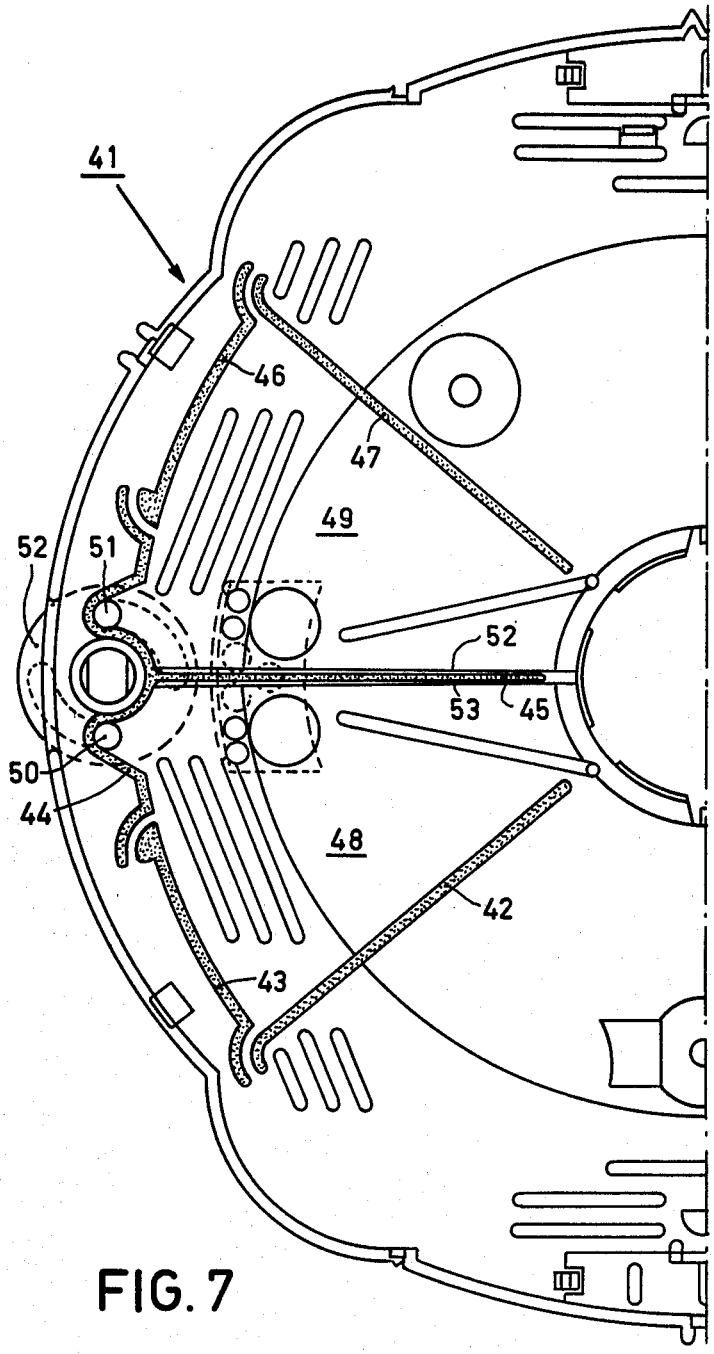
FIG. 7 is a partial front elevation of an alternative embodiment of a supporting member for a deflection unit in accordance with the invention.

FIG. 7 is a front elevation of the left-hand part of a supporting member 41 suitable for supporting coils for a deflection unit in accordance with the invention. Slots 42, 43, 44, 45, 46 and 47 are provided in the supporting member so that partially cut-out parts 48 and 49 are formed. These parts 48 and 49 are provided with catches 50 and 51. An eccentric 52 is journalled in the fixed part of the supporting member 41 with which the catches 50, 51 can be moved towards each other or away from each other and as a result of which the distance between the coils 48, 49 can be varied.

A first coil of a set of line coils may be connected to the part 48, an axial part of the first coil engaging an edge 53. The second coil of the set of line coils may be secured to the part 49, an axial part of the second coil engaging an edge 54. The distance between the oppositely located axial parts of the first and second coils is adjustable by rotating eccentric 52.

For correcting line asymmetry and line astigmatism defects, only small coil displacements prove to be necessary. These vary from a few tenths of a millimeter to a millimeter.

What is claimed is:

1. A color display tube having three electron guns which are positioned in one plane for projecting three electron beams towards a display screen, and having a deflection device which is mounted on the display tube, said deflection device having a substantially frustoconical supporting member with a front end facing said display screen having a large diameter and a rear end facing said electron guns having a relatively small diameter, which member supports a first set of deflection coils arranged about the longitudinal axis of said tube deflecting the three electron beams in a first direction, and a second set of deflection coils arranged about said axis for deflecting the three electron beams in a second direction orthogonal to said first direction, the first set of deflection coils comprising two coils one of which is provided opposite to and spaced from the other in the supporting member, each coil being formed by two longitudinal parts extending substantially parallel to said axis and being connected at their respective front and rear ends by transverse parts, characterized in that adjusting means, cooperating with the longitudinal parts of the coils of the first set, are provided so as to vary the distances between the adjoining longitudinal parts of said coils at least at one end of the supporting member, and pressure means for keeping the said longitudinal parts of said coils in contact with the adjusting means.

2. A color display tube as claimed in claim 1, characterized in that the two coils of the first set of deflection coils are positioned symmetrically relative to the plane in which the three electron guns are positioned.

3. A color display tube as claimed in claim 1 or 2, characterized in that the front end of the supporting member has a lip and the pressure means comprises of two resilient elements placed diametrically opposite to each other between the lip and the front transverse parts of the coils.

4. A color display tube as claimed in claim 3, characterized in that near the rear side of the support member fixed spacers are located thereon between the two coils of said first set of deflection coils said fixed spacers having a width at least equal to the smallest width of the adjusting means but not larger than the greatest width of said adjusting means.

5. A color display tube as claimed in claim 3, characterized in that the adjusting means comprises two wedge-shaped spacers each of which is movable in the longitudinal direction of the respective spaces formed between the said adjoining longitudinal parts of said coils.

6. A color dislay tube as claimed in claim 5, characterized in that each spacer is in the form of an elongate member which tapers from the front end to the rear end of the supporting member.

7. A color display tube as claimed in claim 6, characterized in that the spacers can be operated from the front end of the supporting member.

8. A color display tube as claimed in claim 5, characterized in that the spacers can be operated from the front end of the supporting member.

9. A color display tube as claimed in claim 1 or 2, characterized in that the adjusting means comprises two eccentrics which are rotatable about axes and which are respectively positioned in the spacers formed between the said adjoining longitudinal parts of said coils.

10. A color display tube as claimed in claim 1 or 2, characterized in that the adjusting means comprises two wedge-shaped spacers each of which is movable in the longitudinal direction of the respective spaces formed between said adjoining longitudinal parts of said coils.

11. A color display tube as claimed in claim 10, characterized in that each spacer is in the form of an elongate member which tapers from the front end to the rear end of the supporting member.

12. A color display tube as claimed in claim 11, characterized in that the spacers can be operated from the front end of the supporting member.

13. A color display tube as claimed in claim 10, characterized in that the spacers can be operated from the front end of the supporting member.

14. A color display tube as claimed in claim 1, characterized in that the adjusting means comprises four cams movable in the front of the supporting member, each cam cooperating with an internal surface of one of the corners formed between a longitudinal part and a front transverse part of said coils, in which, for increasing the distance between a first set of two oppositely located longitudinal parts of said coils and simultaneously decreasing the distance between the other set of oppositely located longitudinal parts of said coils, the cams cooperating with the first set of two oppositely located longitudinal parts of said coils can be moved apart, and conversely.

15. A deflection device for a color display tube havin three electron guns positioned in one plane, said device comprising a substantially frustoconical supporting member having a front end with a large diameter and a rear end with a relatively small diameter, which member supports a first set of deflection coils arranged about its longitudinal axis for generating a magnetic deflection field in a first direction and a second set of deflection coils arranged about said axis for generating a magnetic deflection field in a second direction orthogonal to said first direction, the first set of deflection coils comprising two coils one of which is provided opposite to and spaced from the other in the supporting member, each coil being formed by two longitudinal parts extending substantially parallel to said axis and being connected at their respective front and rear ends by transverse parts, characterized in that adjusting means cooperating with the longitudinal parts of the coils of the first set are provided so as to vary the distances between the adjoining longitudinal parts at least at one end of the supporting member, and pressure means for keeping the said longitudinal parts in contact with the adjusting means.

16. A deflection device as claimed in claim 15, characterized in that the two coils of the first set of deflection coils are symmetrical relative to the plane in which the three electron guns are positioned.

17. A deflection device as claimed in claim 15 or 16, characterized in that the front end of the supporting member has a lip and that the pressure means consists of two resilient elements placed diametrically opposite to each other between the lip and the front transverse parts of the coils.

18. A deflection device as claimed in claim 17, characterized in that the adjusting means comprises two wedge-shaped spacers each of which is movable in the longitudinal direction of the respective slots formed between said adjoining longitudinal parts of said coils.

19. A deflection device as claimed in claim 15 or 16, characterized in that the adjusting means comprises two wedge-shaped spacers each of which is movable in the longitudinal direction of the respective slots formed between said adjoining longitudinal parts of said coils.

20. A deflection device as claimed in claim 15, characterized in that the adjusting means comprises two eccentrics which are rotatable about axes and which are respectively positioned in the spaces formed between said adjoining longitudinal parts of said coils.

21. A deflection device as claimed in claim 15, characterized in that the adjusting means comprises four cams movable in the front of the supporting member, each cam cooperating with an internal surface of one of the corners formed between a longitudinal part and a front transverse part of said coils, in which, for increasing the distance between a first set of two oppositely located longitudinal parts of said coils and simultaneously decreasing the distance between the other set of oppositely located longitudinal parts, the cams cooperating with the first set of two oppositely located longitudinal parts of said coils can be moved apart, and conversely.

22. A deflection device as claimed in claim 15, characterized in that the supporting member, at least at one end, is divided into two parts along the plane in which the non-deflected electron beams extend, a coil of the first set of deflection coils being provided on each of said parts and that the adjusting means comprise two eccentrics with which the two parts of the supporting member can be moved relative to each other.

23. A deflection device as claimed in claim 15, characterized in that each axial part of the coils of the first set of coils is connected to a partially cutout part of the supporting member and that every two oppositely located cut-out parts are movable relative to each other by means of an eccentric journalled on the supporting member.

* * * * *